US012753918B2

(12) United States Patent
Schalles

(10) Patent No.: US 12,753,918 B2
(45) Date of Patent: Oct. 6, 2026

(54) BURNER AND METHOD FOR HYDROGEN COMBUSTION WITH ENHANCED LUMINOSITY

(71) Applicant: Bloom Engineering Company, Inc., Pittsburgh, PA (US)

(72) Inventor: David G. Schalles, Jefferson Hills, PA (US)

(73) Assignee: Bloom Engineering Company, Inc., Norwalk, CT (US)

( * ) Notice: Subject to any disclaimer, the term of this patent is extended or adjusted under 35 U.S.C. 154(b) by 716 days.

(21) Appl. No.: 18/030,384

(22) PCT Filed: Oct. 6, 2021

(86) PCT No.: PCT/US2021/053721

§ 371 (c)(1),
(2) Date: Apr. 5, 2023

(87) PCT Pub. No.: WO2022/076524

PCT Pub. Date: Apr. 14, 2022

(65) Prior Publication Data

US 2023/0366538 A1 Nov. 16, 2023

Related U.S. Application Data

(60) Provisional application No. 63/087,945, filed on Oct. 6, 2020.

(51) Int. Cl.
*F23D 14/24* (2006.01)
*F23D 14/66* (2006.01)

(52) U.S. Cl.
CPC ..... *F23D 14/24* (2013.01); *F23D 14/66* (2013.01)

(58) Field of Classification Search
CPC ..... F23D 14/24; F23D 14/66; F23D 14/32; F23D 17/002; F23L 2900/07005;
(Continued)

(56) References Cited

U.S. PATENT DOCUMENTS 3,656,878 A 4/1972 Wright
4,942,832 A 7/1990 Finke
(Continued)

FOREIGN PATENT DOCUMENTS

CN 1884910 A 12/2006
CN 101360952 A 2/2009
(Continued)

OTHER PUBLICATIONS

Third Office Action dated Jan. 13, 2026 for corresponding Chinese Patent Application No. 202180076308.2; English translation included.

*Primary Examiner* — Avinash A Savani
(74) *Attorney, Agent, or Firm* — K&L Gates LLP

(57) ABSTRACT

A combustion burner using hydrogen as the primary fuel and including a burner housing, a hydrogen fuel conduit extending within the housing and defining a hydrogen fuel exit opening, a combustion air conduit extending within the housing and defining a combustion air exit opening, a hydrocarbon fuel conduit defining a hydrocarbon fuel exit opening, and a mixing/combustion zone in which the hydrogen fuel, the combustion air, and the hydrocarbon fuel mix and combustion takes place. The hydrocarbon fuel exit opening is positioned such that the hydrocarbon fuel is heated prior to mixing with the combustion air injected from the combustion air opening. Also, a method of firing a combustion burner using hydrogen as the primary fuel, where hydrogen fuel, combustion air, and hydrocarbon fuel are injected into a mixing/combustion zone of the combus-
(Continued)

tion burner such that the hydrocarbon fuel is heated prior to mixing with the combustion air.

17 Claims, 12 Drawing Sheets

(58) Field of Classification Search
CPC .. F23N 2237/14; F23N 2237/08; F23C 6/047; F23C 2900/9901; Y02E 20/34
USPC ..... 431/159
See application file for complete search history.

(56) References Cited

U.S. PATENT DOCUMENTS

| | | | | |
|---|---|---|---|---|
| 4,995,805 | A | 2/1991 | Hilliard | |
| 5,180,300 | A | 1/1993 | Hovis et al. | |
| 5,222,447 | A | 6/1993 | Joshi et al. | |
| 5,248,252 | A | 9/1993 | Delichatsios et al. | |
| 5,368,472 | A | 11/1994 | Hovis et al. | |
| 6,471,508 | B1 | 10/2002 | Finke et al. | |
| 6,685,463 | B2 | 2/2004 | Finke et al. | |
| 6,767,376 | B1 * | 7/2004 | Perna | C01B 3/382 422/628 |
| 6,793,486 | B2 | 9/2004 | Finke et al. | |
| 7,175,423 | B1 | 2/2007 | Pisano et al. | |
| 7,871,262 | B2 | 1/2011 | Carroni et al. | |
| 8,091,536 | B2 | 1/2012 | Munshi et al. | |
| 8,696,348 | B2 | 4/2014 | Cao et al. | |
| 8,747,101 | B2 * | 6/2014 | Rusch | F23D 11/44 431/207 |
| 2003/0008255 | A1 | 1/2003 | Finke et al. | |
| 2007/0172785 | A1 | 7/2007 | Stephens et al. | |
| 2007/0254251 | A1 | 11/2007 | Cao et al. | |
| 2011/0094239 | A1 | 4/2011 | Koizumi et al. | |
| 2017/0276344 | A1 * | 9/2017 | Schreiner | F23L 7/007 |
| 2017/0283713 | A1 | 10/2017 | Stephens et al. | |
| 2017/0321609 | A1 * | 11/2017 | Ogata | F02C 7/228 |
| 2017/0356656 | A1 | 12/2017 | Ogata et al. | |
| 2018/0172277 | A1 | 6/2018 | Bulat et al. | |
| 2018/0224122 | A1 * | 8/2018 | Mimura | F23D 14/66 |

FOREIGN PATENT DOCUMENTS

| | | | |
|---|---|---|---|
| CN | 102032568 | A | 4/2011 |
| CN | 102297426 | A | 12/2011 |
| CN | 204922979 | U | 12/2015 |
| CN | 109073212 | A | 12/2018 |
| CN | 118009313 | A | 5/2024 |
| JP | H921509 | A | 1/1997 |
| JP | 2003148709 | A | 5/2003 |
| JP | 2007285552 | A | 11/2007 |
| JP | 2008202902 | A | 9/2008 |
| SU | 314973 | | 9/1971 |
| SU | 366314 | | 1/1973 |
| UA | 34812 | A | 3/2001 |

* cited by examiner

BURNER AND METHOD FOR HYDROGEN COMBUSTION WITH ENHANCED LUMINOSITY

CROSS REFERENCE TO RELATED APPLICATIONS

This application is the United States nation phase of International Application No. PCT/US21/53721 filed Oct. 6, 2021, and claims priority to U.S. Provisional Patent Application No. 63/087,945, filed Oct. 6, 2020, the disclosures of which are hereby incorporated by reference in their entireties.

BACKGROUND OF THE INVENTION

Field of the Invention

The present invention is directed to a burner for the combustion of hydrogen as a main fuel and a method of using such a burner where the burner increases the luminosity of the flame produced by combustion of the hydrogen.

Description of Related Art

Fossil fuels (natural gas, coal, oil, etc.) are the major source of energy for most of the industrialized world. Complete combustion of hydrocarbons (which are the bulk of the components of fossil fuels) will generate carbon dioxide ($CO_2$) in the waste gases. The scientific community generally accepts that atmospheric carbon dioxide contributes to climate change, and jurisdictions, domestic and international, are working towards limiting formation of $CO_2$.

There has been intense research to find economically viable and sustainable ways to minimize atmospheric carbon dioxide, especially as it relates to combustion. Perhaps the most straightforward way to do so would be simply to burn less fuel either through improvements in combustion efficiency, process efficiency or both. Even though every industry has room to make gains in efficiency, humans have been doing things like smelting ore and firing clay pots for thousands of years, and further efficiency gains in these kinds of industries are probably limited.

Another way to decrease atmospheric carbon dioxide is to remove it from the atmosphere and store it somewhere. By chemically removing the carbon from the waste gas stream, and then later transporting it to a location (generally underground) where it is possible to store it safely away from atmosphere, it is possible to remove up to 90% of the carbon dioxide from the waste gas stream. There is generally a large expense in both capital dollars and operational dollars. Furthermore, there is an associated "energy penalty" associated with capturing, compressing, transporting and storing the carbon dioxide.

Increased use of renewable sources of energy (wind, solar, geothermal, etc.) are candidates, as well as nuclear fission, or use of biomass as fuel.

Another option is to choose a fuel that does not have carbon in it at all. If there is no carbon in the fuel, then there cannot be any carbon dioxide in the waste gas. One such fuel that has generated quite a bit of interest over the past 30-40 years is molecular hydrogen ($H_2$). However, hydrogen presents several challenges when used as a fuel source.

Because Hydrogen is less dense (at standard temperature and pressure) compared to other fuels, flame speeds for hydrogen are much faster, flame temperatures are higher, and diffusion and mixing of fuel and oxygen are faster. Furthermore, the higher flame temperatures, and faster mixing also enhance the production of nitrogen oxides ($NO_x$) which are almost universally restricted as known pollutants.

Further, while many existing combustion burners can be adapted for hydrogen firing, there are some drawbacks and special considerations. Air/hydrogen combustion tends to raise NOx emissions, increase flame intensity, shorten the heat release pattern, and eliminate any visible luminosity of the flame as compared to air/hydrocarbon combustion.

At least some industrial heating applications would incur decreased productivity or decreased thermal efficiency due to reduction of radiant heat transfer from the reduced luminosity hydrogen flames. This may be especially important in applications where radiant heat transfer is the dominant heat transfer mode, such as aluminum melting, steel reheating, and glass melting. In fact, glass melting is a unique application due to the transparent material allowing thermal radiation to penetrate through the bath material during the process.

Prior art burners and methods, such as the burners and methods described in U.S. Pat. No. 8,091,536, United States Patent Application Publication Nos. US 2017/0356656 and US 2018/0172277, and Chinese Patent Application Publication No. CN 102297426, use hydrogen as a fuel in addition to a hydrocarbon fuel, but do not provide any means for increasing any reduction in luminosity that may result from the use of hydrogen. Other prior art burners and methods, such as the burners and methods described in U.S. Pat. Nos. 3,656,878, 4,995,805, 5,222,447, and 5,248,252 and Japanese Patent Application Publication No. H09-21509, provide for increased luminosity of a hydrocarbon fueled flame. In these patents, a hydrocarbon gas is combusted and the products of combustion are introduced into the primary combustion flame, an electric arc is used to pyrolize a portion of the hydrocarbon fuel prior to combustion, the hydrocarbon fuel is mixed with carbon black prior to combustion, a portion of the hydrocarbon fuel is cracked in an auxiliary heater prior to combustion, or sodium carbide is added during combustion.

None of the prior art burners and methods increase the luminosity of a hydrogen fueled flame. In addition, none of the prior art burners and methods utilize cracking of a hydrocarbon fuel within a combustion/mixing zone of the burner thereby eliminating the need for an auxiliary heater. It is therefore an object of the present invention to provide a burner and a method utilizing hydrogen as a main combustion fuel with increased flame luminosity and radiant heat transfer. It is a further object of the invention to provide a burner and a method utilizing hydrogen as a main combustion fuel with increased flame luminosity and radiant heat transfer where all of the reactions necessary to provide the increased luminosity occur within the mixing/combustion zone of the burner.

SUMMARY OF THE INVENTION

The present invention is directed to a combustion burner using hydrogen as the primary fuel. The burner comprises: a burner housing enclosing a plenum; a hydrogen fuel conduit extending longitudinally within the housing and defining a hydrogen fuel exit opening; a combustion air conduit extending longitudinally within the housing and defining a combustion air exit opening; a hydrocarbon fuel conduit defining a hydrocarbon fuel exit opening; and a mixing/combustion zone in which the hydrogen fuel, the combustion air, and the hydrocarbon fuel mix and combustion takes place. The hydrocarbon fuel exit opening is positioned such that the hydrocarbon fuel injected from the hydrocarbon fuel exit opening is heated prior to mixing with the combustion air injected from the combustion air opening.

The combustion air conduit may extend along an axis that is offset from the burner centerline and the hydrogen fuel conduit may extend along an axis that is offset from the burner centerline, such that the combustion air conduit and the combustion air exit opening are positioned on an opposite side of the burner centerline from the hydrogen fuel conduit and the hydrogen fuel exit opening.

The hydrocarbon fuel conduit may extend in a longitudinal direction through the hydrogen fuel conduit and be positioned coaxial with the hydrogen fuel conduit and the burner centerline.

The combustion burner may further comprise a baffle including a baffle face, where the baffle is positioned between the plenum and a burner port block that defines the mixing/combustion zone. Combustion air entering the mixing/combustion zone from the combustion air exit opening and hydrogen fuel entering the mixing/combustion zone from the hydrogen fuel exit opening enter a first area adjacent to the baffle face while hydrocarbon fuel enters the mixing/combustion zone in a second area that is farther from the baffle face than the first area.

Alternatively, the baffle may include a chamber into which hydrogen fuel injected through the hydrogen fuel exit opening and hydrocarbon fuel injected through the hydrocarbon fuel exit opening are injected before entering the mixing/combustion zone and combustion air injected from the combustion air exit opening enters an area adjacent to the baffle face.

The hydrocarbon fuel conduit may extend beyond the baffle face into the mixing/combustion zone. Alternatively, the hydrocarbon fuel conduit may extend in a longitudinal direction along an axis that is offset from the burner centerline and/or offset from an axis along which the hydrogen fuel conduit extends.

The hydrocarbon fuel conduit may surround the hydrogen fuel conduit and the hydrocarbon fuel exit opening is an annulus or multiple openings surrounding the hydrogen fuel exit opening.

The present invention is also directed to a method of firing a combustion burner using hydrogen as the primary fuel. The hydrogen fuel, combustion air, and a hydrocarbon fuel are injected into a mixing/combustion zone of the combustion burner with the hydrocarbon fuel being injected into is the mixing/combustion zone such that the hydrocarbon fuel is heated prior to mixing with the combustion air.

The hydrocarbon fuel may be introduced into a hot zone of the mixing/combustion zone such that at least a portion of the hydrocarbon fuel undergoes thermal decomposition and reformation into carbonaceous soot particles prior to mixing with the combustion air entering the mixing/combustion zone and combusting.

Injection angles and velocities for the introduction of the hydrocarbon fuel and the combustion air may be set to minimize initial mixing of the hydrocarbon fuel with the combustion air, and/or the hydrogen fuel may be injected at a higher velocity than a velocity at which the hydrocarbon fuel is injected.

The combustion air may be enriched with additional oxygen and/or may be preheated prior to being injected into the mixing/combustion zone.

The hydrocarbon fuel is provided as 3-10 volume % of the total injected hydrogen fuel plus hydrocarbon fuel.

The hydrocarbon fuel may preheated prior to introduction into the mixing/combustion zone, such that partial decomposition and reformation of the hydrocarbon fuel occurs prior to the introduction of the hydrocarbon fuel into the mixing/combustion zone.

DESCRIPTION OF THE INVENTION

As used herein, any numerical values are expressed using a period as a decimal point and a comma as a thousand separator, for example, 1,234 would be one thousand two hundred thirty four, and 1.2 would be one and two tenths. Unless otherwise expressly specified, all numbers such as those expressing values, ranges, amounts or percentages may be read as if prefaced by the word "about", even if the term does not expressly appear. Any numerical range recited herein is intended to include all sub-ranges subsumed therein. For example, a range of "1 to 10" is intended to include any and all sub-ranges between and including the recited minimum value of 1 and the recited maximum value of 10, that is, all subranges beginning with a minimum value equal to or greater than 1 and ending with a maximum value equal to or less than 10, and all subranges in between, e.g., 1 to 6.3, or 5.5 to 10, or 2.7 to 6.1. Plural encompasses singular and vice versa. When ranges are given, any endpoints of those ranges and/or numbers within those ranges can be combined with the scope of the present invention. "Including", "such as", "for example" and like terms means "including/such as/for example but not limited to".

The present invention is directed to a burner for the combustion of hydrogen with enhanced luminosity and radiant heat transfer and a method of enhancing the luminosity and radiant heat transfer during hydrogen combustion using such a burner.

Figure 1:
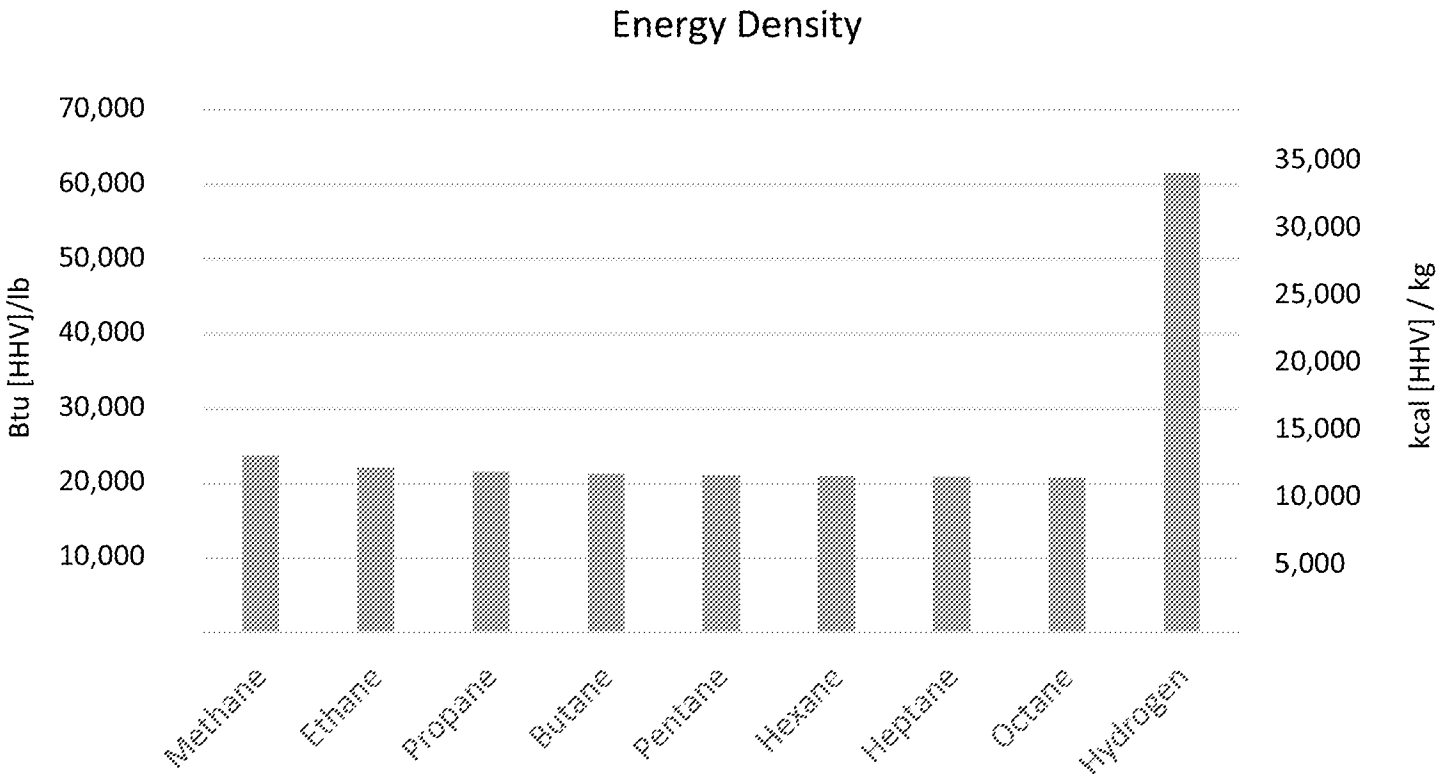
FIG. 1 is a graph showing the energy density of various hydrocarbon fuels as compared to hydrogen.

Hydrogen has several characteristics to recommend it as a potential source of fuel. One of which is its high energy density. Energy density is a measure of how much energy is released from complete combustion of the fuel, either on a mass basis, or on a volume basis. Most hydrocarbons have an energy density on a mass basis of between 20,000-25.000 Btu [HHV]/lb. Hydrogen, however, is almost three times as energy dense. FIG. 1 shows the energy density on a mass basis for several fuels.

The balanced chemical reaction for combustion of hydrogen is informative.

$$H_2+2.5(0.2O_2+0.8\ N_2)\rightarrow H_2O+2\ N_2\ (325\ \text{Btu/scf})\ (3050\ \text{kcal/Nm}^3)$$

Figure 2:
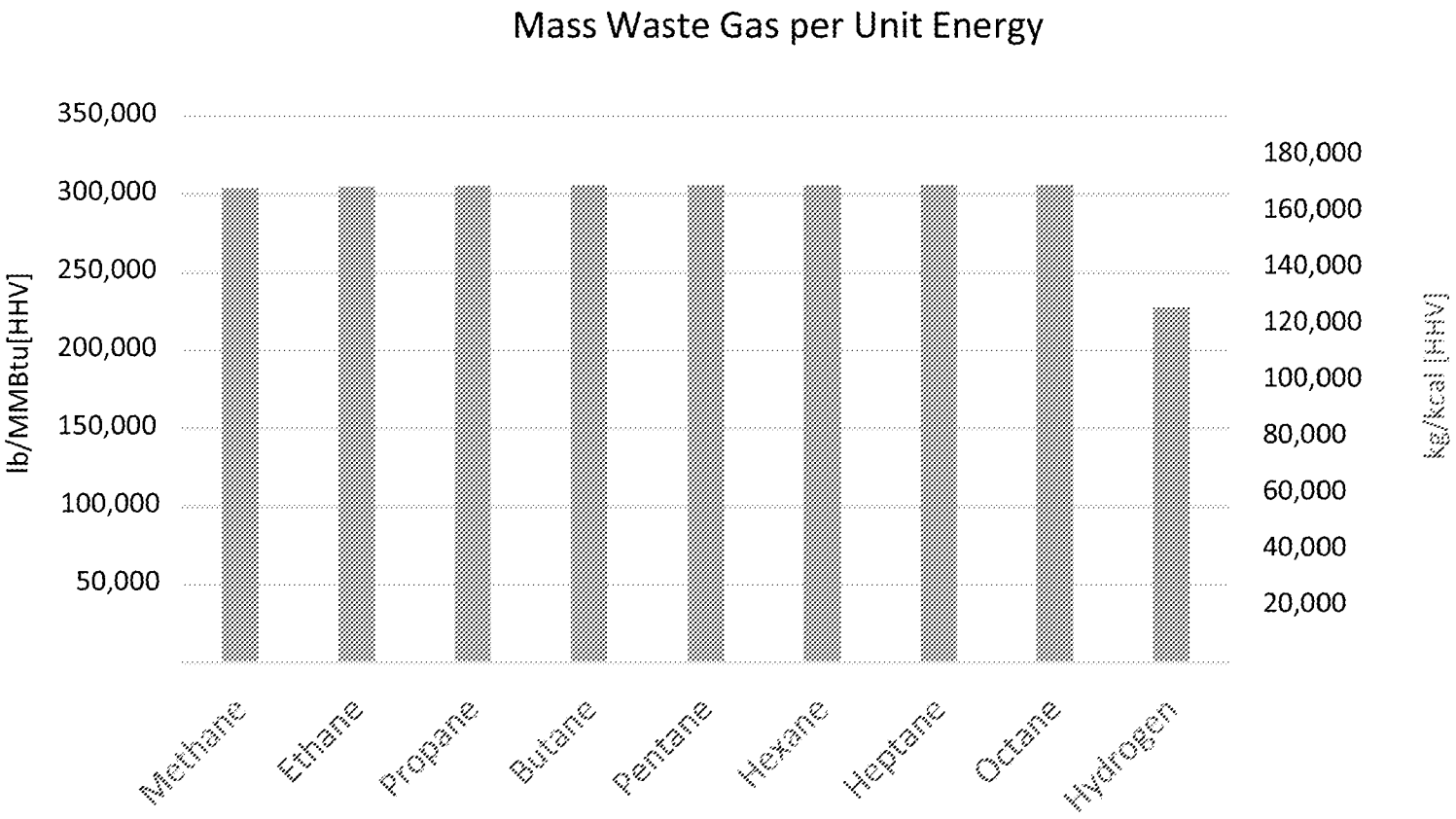
FIG. 2 is a graph showing the mass of waste gas per unit energy for various hydrocarbon fuels as compared to hydrogen.

Comparing the mass of waste gas generated per unit of heat from the various fuels (FIG. 2), it can be seen that, for hydrogen, there is less mass of waste gas to move through an exhaust system for a given amount of energy. Similarly, about 25% less air (relative to combustion of hydrocarbons) is required per unit of energy, meaning that combustion air delivery systems (fans, blowers, etc.) can be correspondingly smaller. Finally, as discussed above, combustion of hydrogen generates no carbon dioxide. Because there is no carbon in the reactants (fuel and air) there can be no carbon in the products (waste gas).

Hydrogen has thermophysical properties that vary from those of hydrocarbons, and other properties of hydrogen, such as flame speed, flammability limits, and luminosity, are sufficiently dissimilar to hydrocarbons as to require special considerations. These factors are taken into consideration in the inventive burner and method.

Figure 3:
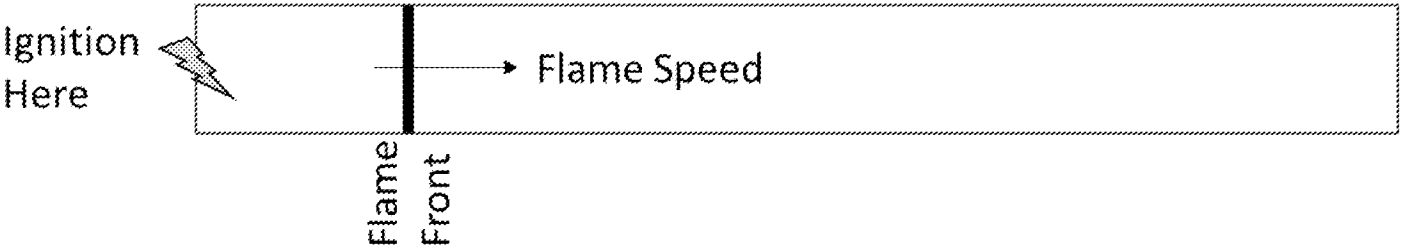
FIG. 3 is a schematic illustrating flame speed.

Flame Speed—One of the largest differences between hydrogen and hydrocarbons is flame speed, which is the speed at which the combustion reaction propagates through space. FIG. 3 conceptualizes flame speed and shows a quiescent mixture of air and a fuel in a tube. Providing a source of ignition to the left end of the tube will start the combustion. The chemical reaction will move to the right at a given velocity.

Figure 4:
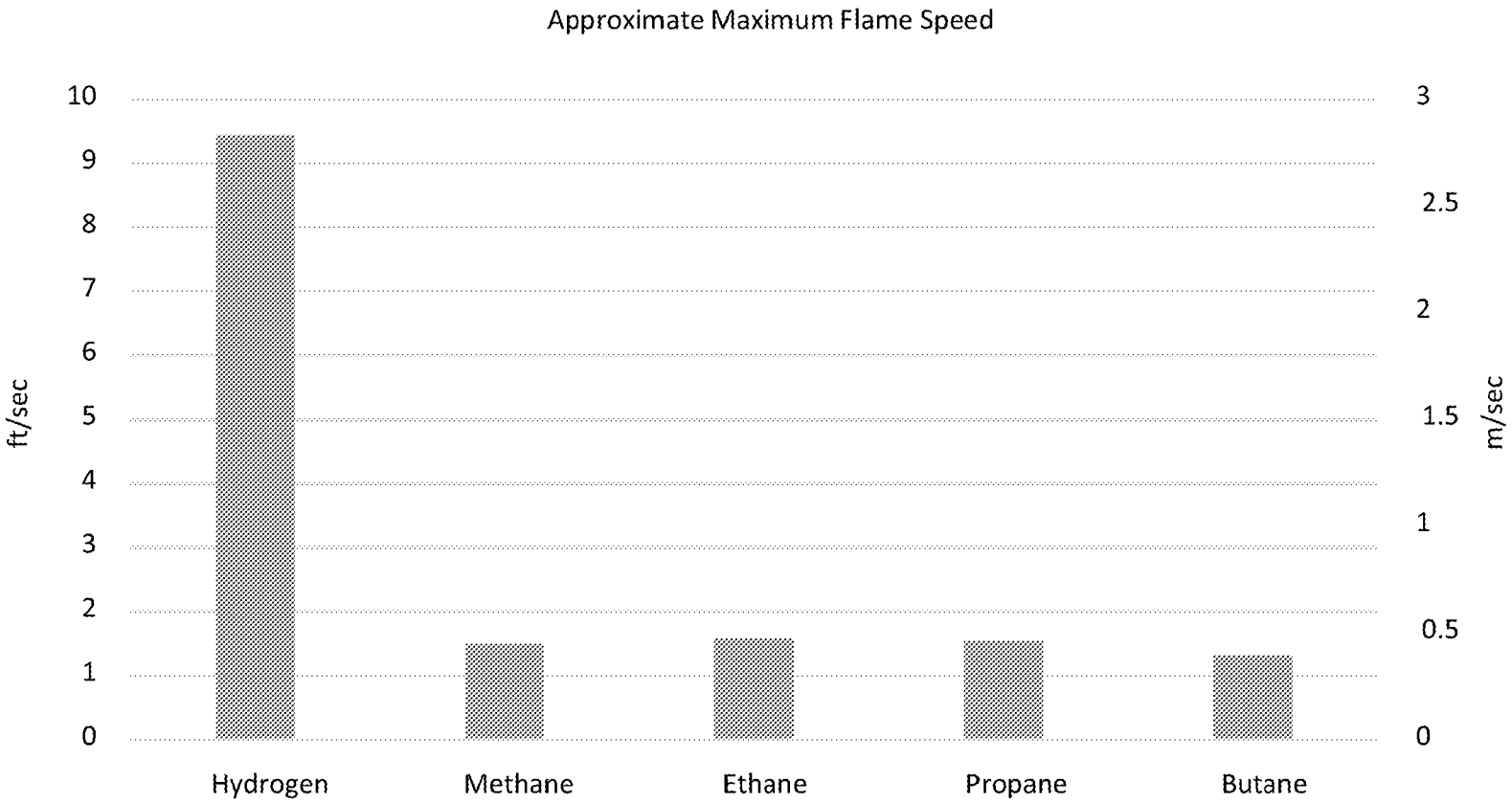
FIG. 4 is a graph showing the flame speed for various hydrocarbon fuels as compared to hydrogen.

The exact velocity depends on several factors such as temperature, pressure, heat transfer, etc. Considering the relative velocity of various fuels as shown in FIG. 4, it can be seen that hydrogen has a flame velocity that is about 10 times that of hydrocarbons.

The inventive burner delivers the fuel and the oxygen (usually in the form of air) into the chamber where the process heat is required. If the flame is traveling back toward the burner faster than the combustion system is able to push the air and gas into the chamber, then the resulting flame pattern and heat release can be affected. In the case where air and fuel are premixed, the combustion could travel into the combustion system causing "flashback". Not only is this situation dangerous, it also delivers the heat to a location that is not useful to the process.

Because hydrogen flame speeds are so fast, hydrogen is particularly susceptible to flashback. Velocity of a fluid is proportional to the square of the pressure drop through a system. Therefore, increasing the velocity by a factor of ten requires by changing the fuel from a hydrocarbon to hydrogen requires increasing the pressure drop through the system by a factor of 100. Rarely is such an increase practical or even possible. There are mitigating factors such as the difference in fuel specific gravity that would reduce this number somewhat, but the resulting pressure increase is still generally not practical to achieve. Therefore, other factors must be used to account for this characteristic of hydrogen.

Figure 5:
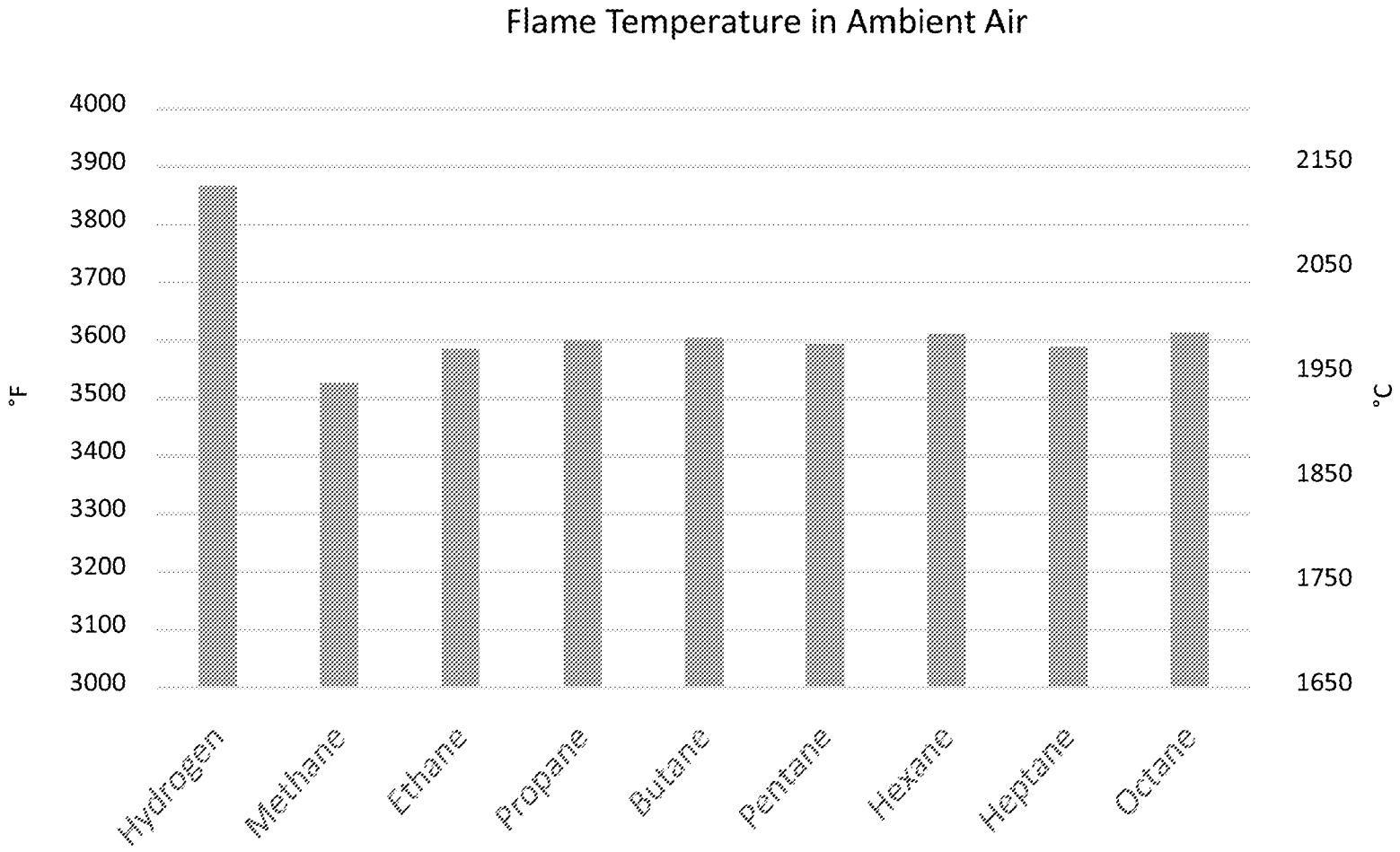
FIG. 5 is a graph showing the flame temperature in ambient air for various hydrocarbon fuels as compared to hydrogen.

Flame Temperature—FIG. 5 shows that flame temperature is also noticeably higher for hydrogen flames. Therefore, the burner and furnace materials, such as refractories for baffles and port blocks as well as auxiliary equipment, such as ignitors and flame safety equipment of the inventive burner are chosen to accommodate higher temperature and more intense flames.

Heating Patterns—The combination of faster flame velocity and higher flame temperature leads to altered flame geometry and heat release patterns. High velocity flames are generally more compact and more intense, which can lead to uneven heat in the process chamber. Therefore, as discussed below the inventive burner may use staging, where fuel and/or air are delivered into the flame envelope in different amounts and locations to spread out the heat release, thus lengthening the flame.

Figure 6:
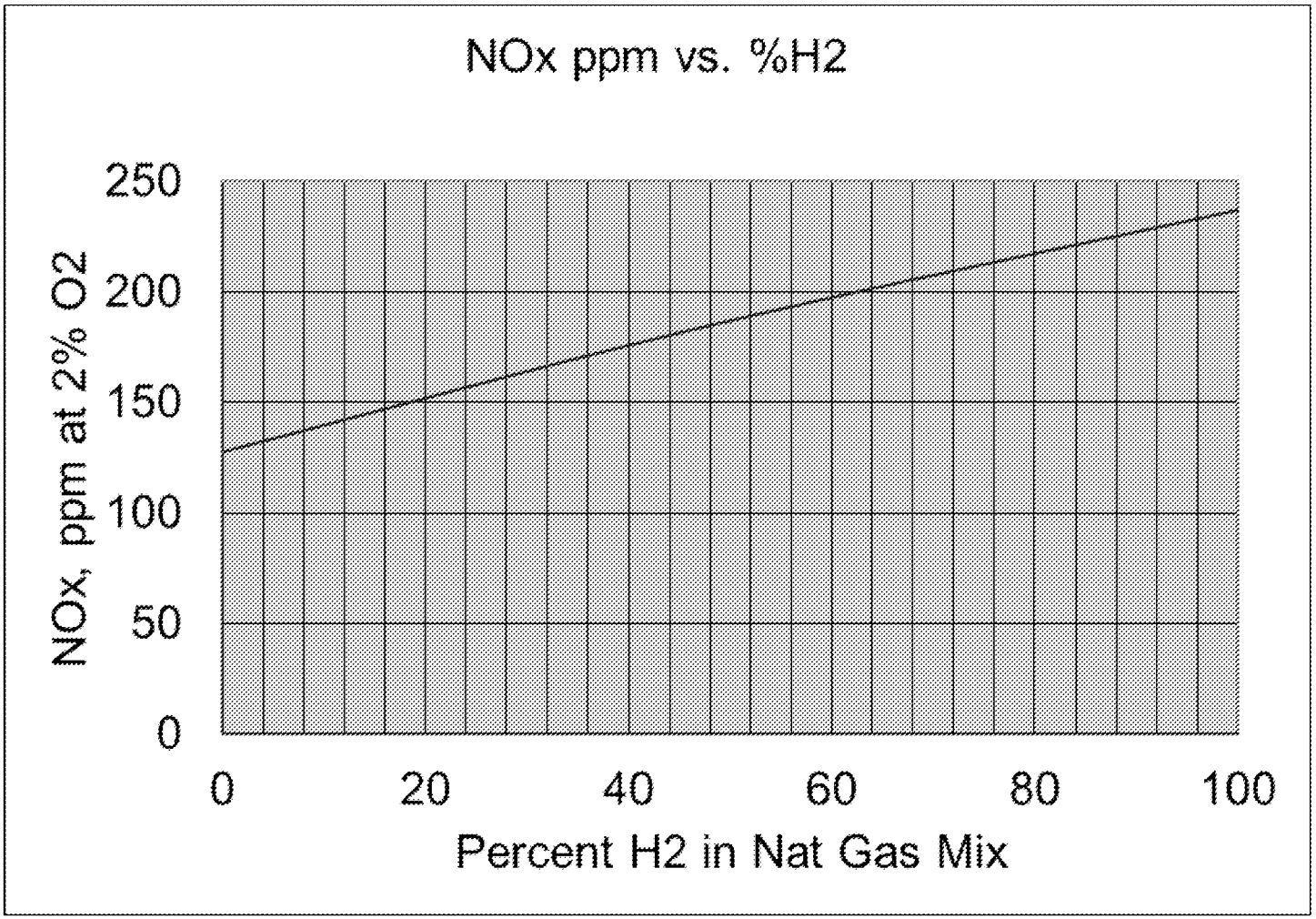
FIG. 6 is a graph showing the relationship between the hydrogen content of a hydrogen/natural gas fuel and NOx generation.

$NO_x$ Formation—With hydrogen, the high intensity flame and the extremely fast mixing causes a relative increase in the formation of NOx. FIG. 6 shows a trend in NOx formation as a function of the percent of hydrogen mixed with natural gas (methane). As mentioned above, the inventive burner may include staging which will reduce the formation of NOx. In general, higher burner pressure also causes a decrease in NOx. The decrease is due to higher velocity and more entrainment of furnace waste gas into the root of the flame, thus lowering the temperature of the flame and abating its intensity.

Heat Transfer and Flame Visibility—One side effect of a carbon-free flame is that the luminosity is greatly reduced, meaning that the flame may be invisible to the human eye in contrast to hydrocarbon flames which are usually visible over all normal operational limits. Direct radiation in the visible spectrum decreases, leading to a decrease in radiant heat transfer from the flame. Not all flame radiation occurs in the visible spectrum, though, and the tri-atomic water molecules themselves will provide some level of radiant transfer. In the claimed burner and method, 3-10% by volume of the total fuel supplied to the burner is a hydrocarbon fuel with the remainder being hydrogen, which provides enough luminosity to create a visible flame and enhance heat transfer from the flame without generating an appreciable amount of carbon dioxide.

The burner 10 includes a burner housing 12. The burner housing 12 defines a combustion air inlet 12 and encloses a burner plenum 14. The combustion air inlet 12 is in fluid communication with the burner plenum 14.

A baffle 16 is generally positioned between the plenum 14 and a burner port block 18 that defines a mixing/combustion zone 20. A sidewall 22 of the burner port block 18 may have a predetermined flare angle. The baffle 16 further includes a baffle face 24.

The burner housing 12 also defines a hydrogen fuel inlet 26. The hydrogen fuel inlet 26 is in fluid communication with a hydrogen fuel conduit 28 that extends in a longitudinal direction within the burner housing 12 and is positioned coaxial with the burner centerline 1. The hydrogen fuel conduit 28 extends through the baffle 16 and defines a hydrogen fuel exit opening 30. The hydrogen fuel exit opening 30 may be flush with the baffle face 24 or the hydrogen fuel conduit 28 may extend beyond the baffle face 24 such that the hydrogen fuel exit opening 30 is located at least partially in the mixing/combustion zone 20.

The baffle 16 defines at least one combustion air conduit 32 that extends through the baffle 16 and connects to the burner plenum 14. The baffle 16 may include a plurality of combustion air conduits 32. Each combustion air conduit 32 extends in a direction parallel to the burner axis 1 and defines one or more combustion air exit openings 34. The combustion air exit opening 34 may be flush with the baffle face 24. A plurality of combustion air exit openings 34 may be positioned surrounding the hydrogen fuel exit opening 30, and may be equally spaced around a circle that surrounds the hydrogen fuel exit opening 30.

Alternatively, the introduction of the hydrogen and the combustion air into the mixing/combustion chamber may be non-symmetrical, where the at least one combustion air conduit extends in a longitudinal direction within the burner housing along an axis that is offset from the burner centerline and the hydrogen fuel conduit extends in a longitudinal direction within the burner housing along an axis that is offset from the burner centerline such that the combustion air conduit and the combustion air exit opening are positioned on an opposite side of the burner centerline from the hydrogen fuel conduit and the hydrogen fuel exit opening. Such a burner is described in U.S. Pat. Nos. 6,471,508 and 6,793,486, the disclosures of which are incorporated herein by reference.

The combustion air conduit 32 may also include swirl vanes for swirling the combustion air as it enters the mixing/combustion zone 20.

Figure 7:
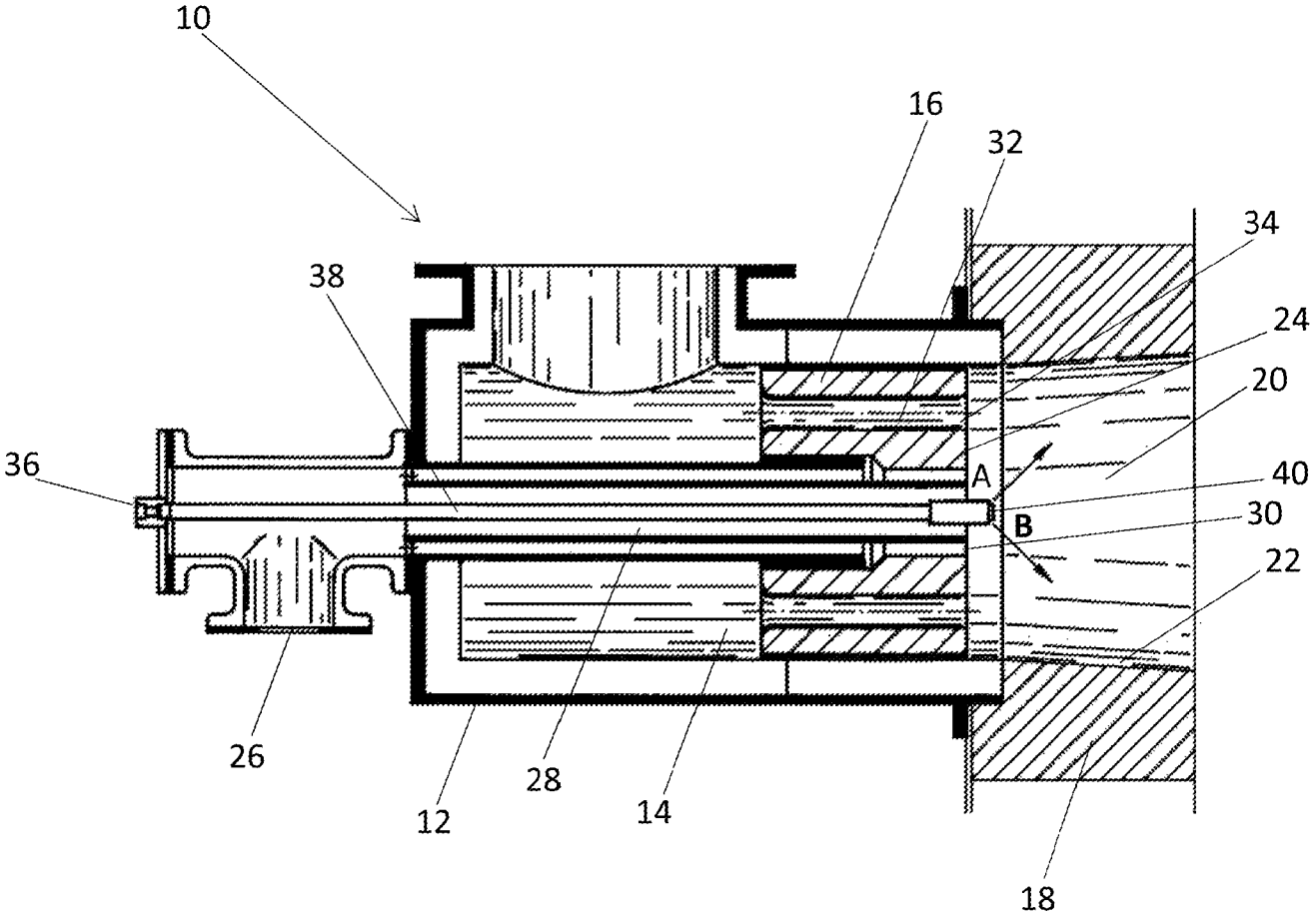
FIG. 7 is a side view cross-section of an embodiment of the inventive burner.

The burner housing 12 also defines a hydrocarbon fuel inlet 36. The hydrocarbon fuel inlet 36 is in fluid communication with a hydrocarbon fuel conduit 28 that extends in a longitudinal direction through the hydrogen fuel conduit 28 and is positioned coaxial with the hydrogen fuel conduit 28 and the burner centerline 1. As shown in FIG. 7, the hydrocarbon fuel conduit 38 may extend beyond the baffle face 24 into the mixing/combustion zone 20 and defines a hydrocarbon fuel exit opening 40. The hydrocarbon fuel exit opening 40 may be nozzle.

Figure 8:
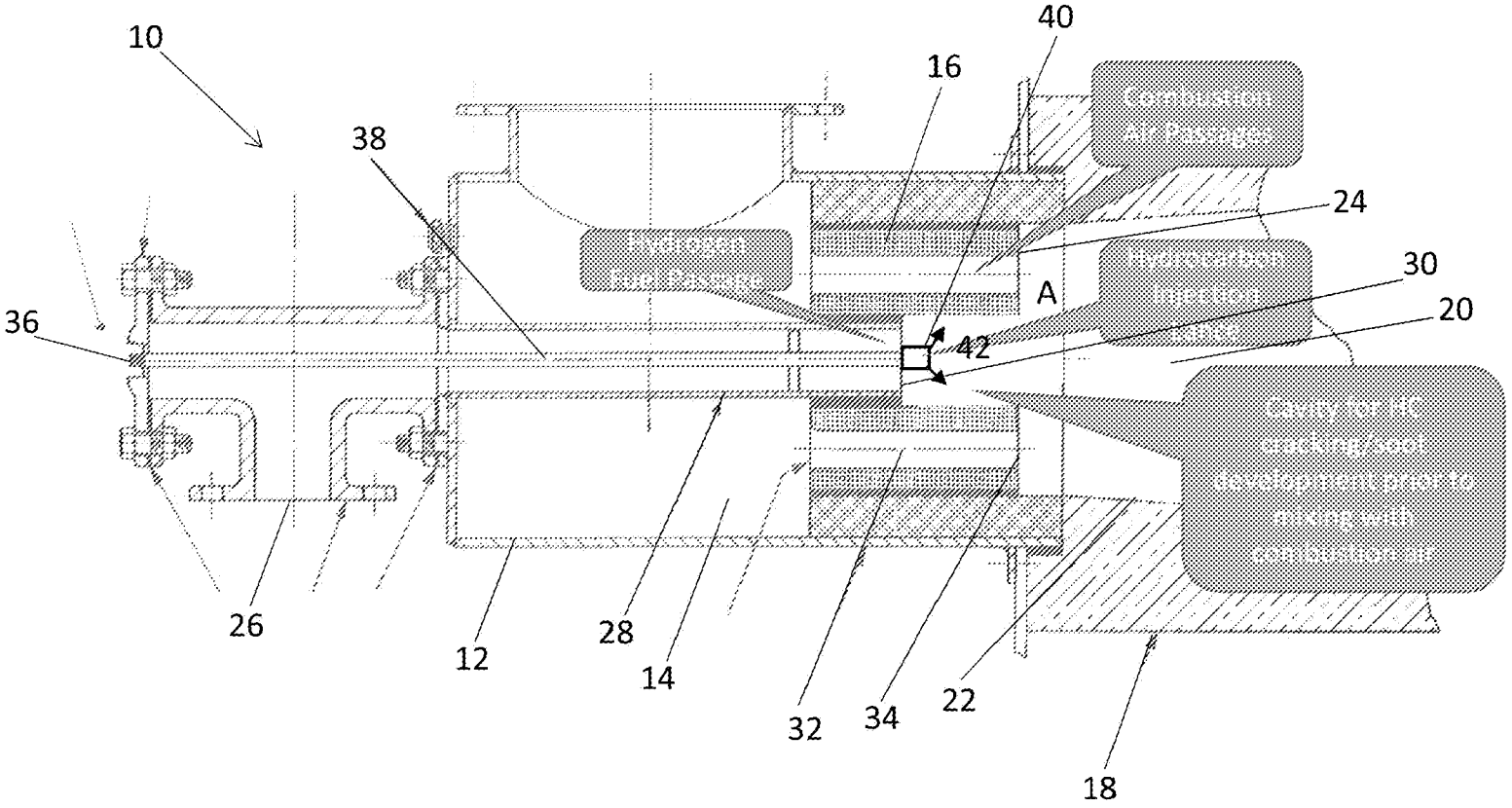
FIG. 8 is a side view cross-section of another embodiment of the inventive burner.
Figure 9:
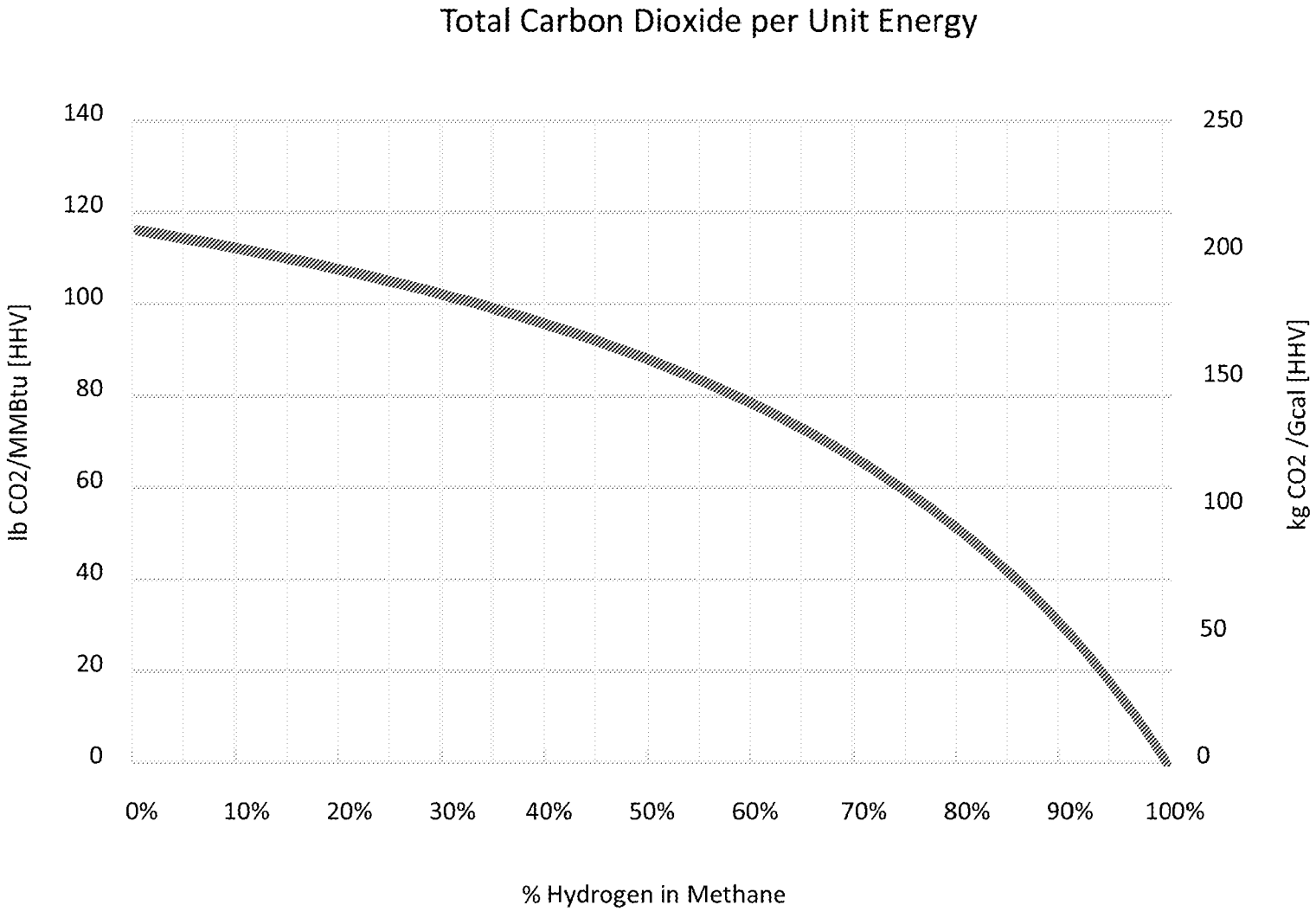
FIG. 9 is a graph showing the relationship between the hydrogen content of a hydrogen/methane fuel and total carbon dioxide generated per unit energy.
Figure 10:
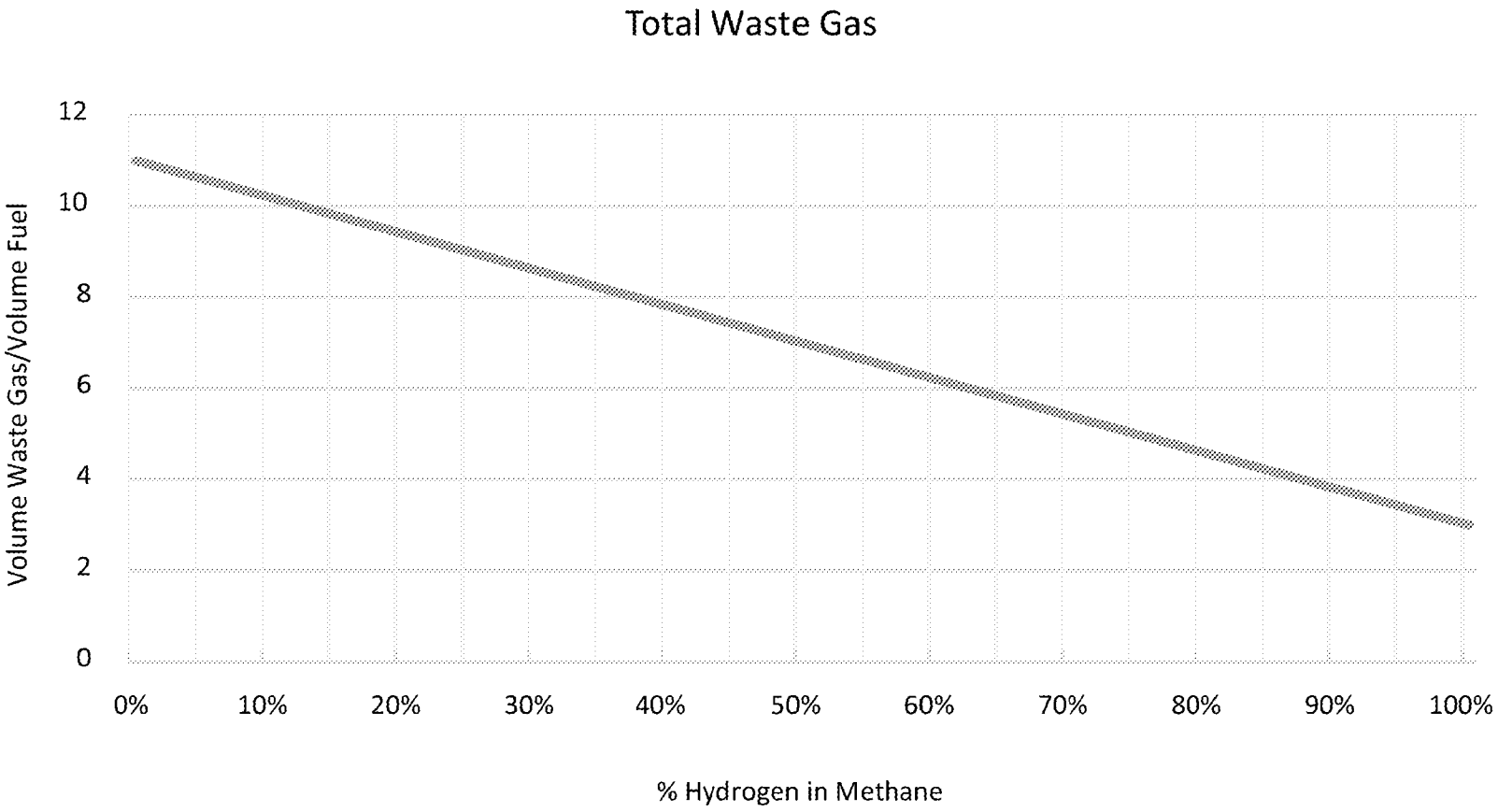
FIG. 10 is a graph showing the relationship between the hydrogen content of a hydrogen/methane fuel and total waste gas.
Figure 11:
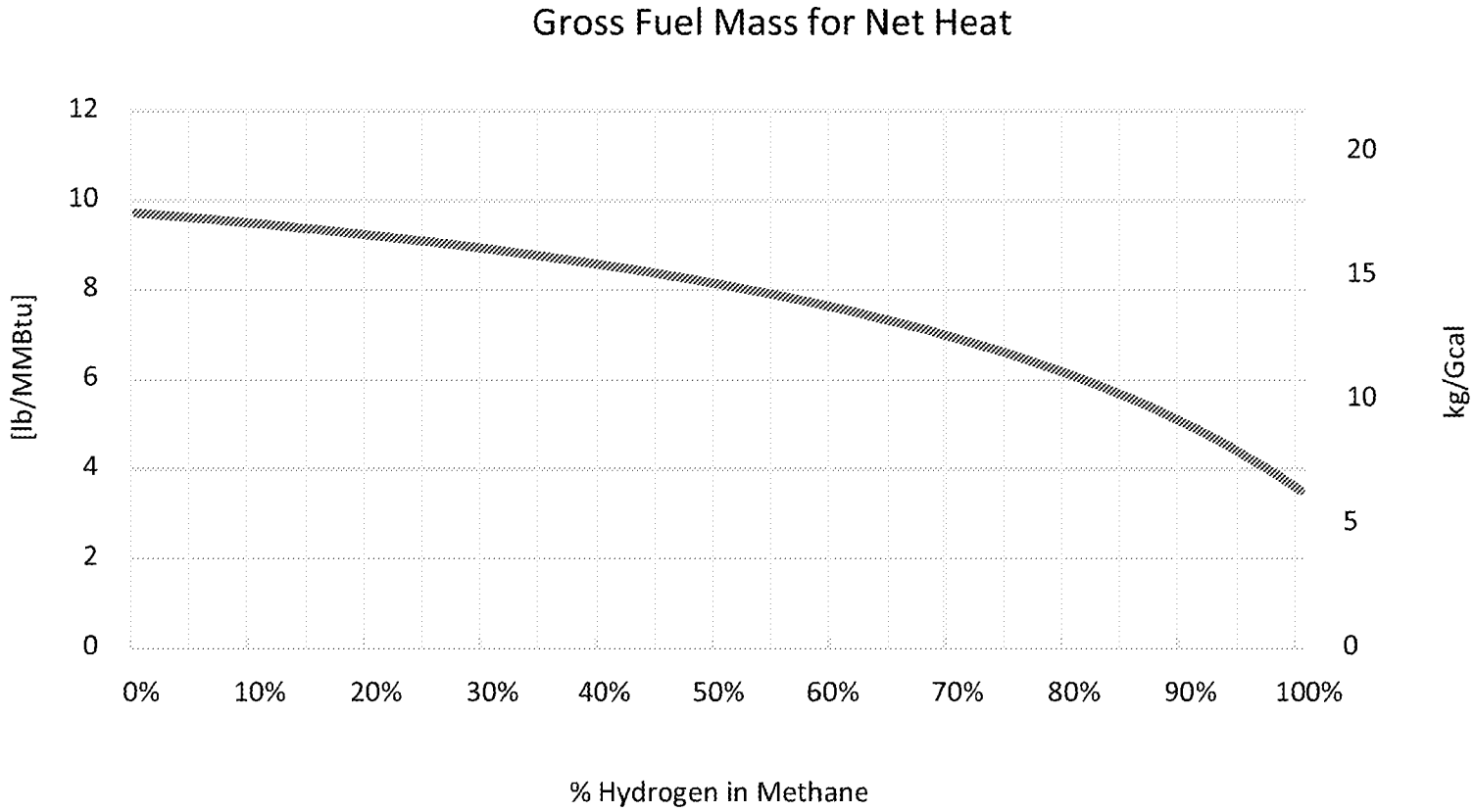
FIG. 11 is a graph showing the relationship between the hydrogen content of a hydrogen/methane fuel and gross fuel mass for net heat.
Figure 12:
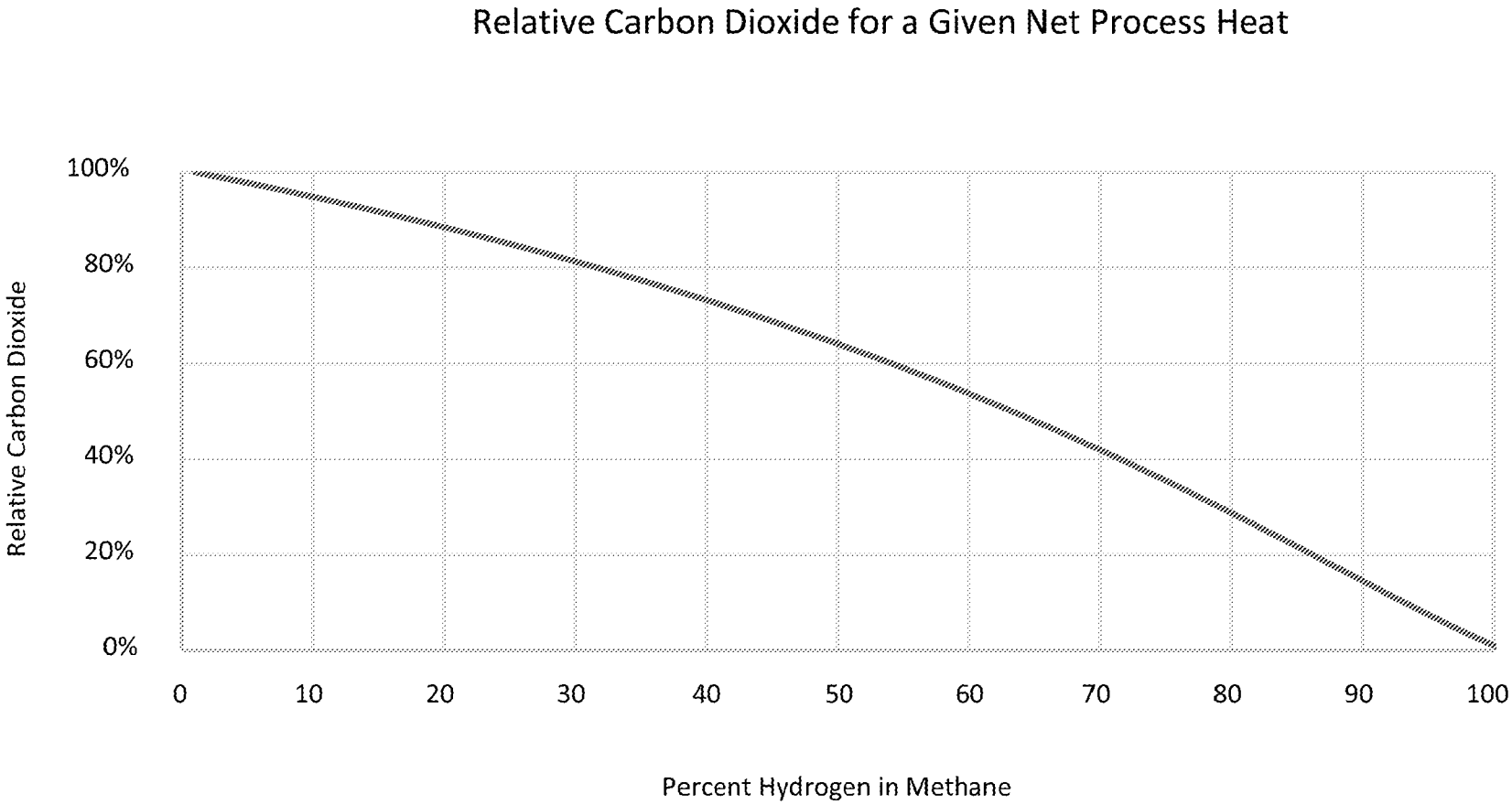
FIG. 12 is a graph showing the relationship between the hydrogen content of a hydrogen/methane fuel and relative carbon dioxide for a given net process heat.

Alternatively, as shown in FIG. 8, the baffle may include a chamber 42 into which the hydrogen injected through the hydrogen fuel exit opening 30 and the hydrocarbon fuel injected through the hydrocarbon fuel exit opening 40 are injected before entering the mixing/combustion zone 20.

Alternatively, the hydrocarbon fuel conduit may extend in a longitudinal direction along an axis that is offset from the burner axis and/or offset from an axis along which the hydrogen fuel conduit extends. In yet another configuration, the hydrocarbon fuel conduit may surround the hydrogen fuel conduit and the hydrocarbon fuel exit opening may be an annulus or multiple openings surrounding the hydrogen fuel exit opening.

The combustion air entering the mixing/combustion zone 20 from the combustion air exit openings 34 and the hydrogen fuel entering the mixing/combustion zone 20 from the hydrogen fuel exit opening 30 may enter an area A adjacent to the baffle face 24 while the hydrocarbon fuel enters the mixing/combustion zone 20 in an area B that is farther from the baffle face 24.

Alternatively, as shown in FIG. 8, the hydrogen fuel injected from the hydrogen fuel exit opening 30 and the hydrocarbon fuel injected through the hydrocarbon fuel exit opening 40 may enter the chamber 42 defined by the baffle 16 and the combustion air injected from the combustion air exit openings 32 may enter an area A adjacent to the baffle face 24.

The hydrocarbon fuel exit opening 40 is configured to introduce hydrocarbon fuel into a hot zone of the mixing/combustion zone 20 such that at least a portion of the hydrocarbon fuel undergoes thermal decomposition, i.e., cracking, and reformation into carbonaceous soot particles prior to mixing with combustion air entering the mixing/combustion zone 20 from the at least one combustion air exit opening 34 and combusting. The cracking may occur in an early portion of the mixing/combustion zone adjacent the baffle face 24 and/or in the chamber 42 shown in FIG. 8. The injection angles and velocities for the introduction of the hydrocarbon fuel and the combustion air may be set to minimize initial mixing of the hydrocarbon fuel with the combustion air stream. The hydrogen fuel may be injected through the hydrogen fuel exit opening 30 at a higher velocity than the velocity of the hydrocarbon fuel exiting the hydrocarbon fuel exit opening 40. The velocity of the hydrogen may be 800-1000 ft/s. Mixing of the combustion air and the hydrogen fuel may occur over the entire length of the flame produced from combustion.

The burner 10 may further include a spark ignition or a pilot for igniting the hydrogen/hydrocarbon fuel or the burner may be lit by auto-ignition above a safety ignition temperature, typically, above 1400° F.

The hydrocarbon fuel may be any hydrocarbon gas capable of decomposition and reformation to form soot. For example, the hydrocarbon fuel may be natural gas, methane, propane, butane, or an alkene such as ethene, propene, or butene. Alternatively, a liquid hydrocarbon capable of decomposition and reformation to form soot may be utilized. For example, the hydrocarbon fuel may be light fuel oil or waste liquids such as benzene and the like.

The combustion air may be enriched with additional oxygen that may, for example, be a byproduct of hydrogen fuel production.

The combustion air may be preheated prior to being injected into the mixing/combustion zone 20. Preheating may be accomplished via recuperative or regenerative heat recovery methods.

The hydrogen fuel may be at least 98% pure, and the hydrocarbon fuel may be provided as at least 3 volume % of the total hydrogen/hydrocarbon fuel provided for combustion and may be provided as at most 10% or at most 5% of the total hydrogen/hydrocarbon fuel provided for combustion, for example, 3-10% of the total hydrogen/hydrocarbon fuel provided for combustion or 3-5% of the total hydrogen/hydrocarbon fuel provided for combustion.

The oxides of nitrogen (NOx) produced as a byproduct of combustion may be reduced by staging the introduction of the hydrogen fuel and/or the combustion air and/or by vitiation as described in U.S. Pat. Nos. 4,942,832, 5,180,300, 5,368,472, 6,685,463, and 7,175,423, the disclosures of which are incorporated herein by reference.

In use, the hydrocarbon fuel is introduced into a hot zone of the mixing/combustion zone 20 such that the hydrocarbon fuel is heated and undergoes thermal decomposition, i.e., cracking, and reformation into carbonaceous soot particles prior to mixing with combustion air entering the mixing/combustion zone 20. The hydrocarbon fuel which has undergone at least some decomposition and reformation then mixes with the hydrogen fuel and combustion air which results in combustion and the formation of a flame. The soot particles entrained in the hydrocarbon fuel and present in the flame provide the flame with increased luminosity.

Alternatively, the hydrocarbon fuel can be preheated prior to introduction into the mixing/combustion zone such that the partial decomposition and reformation of the hydrocarbon fuel occurs prior to the introduction of the hydrocarbon fuel into the mixing/combustion zone 20. Preheating of the hydrocarbon fuel can be conducted using heat transferred from hot combustion air or heat produced in a primary combustion stage utilizing a substoichiometric combustion ratio upstream of the introduction of the hydrogen fuel injection.

During low production times, when enhanced luminosity and radiant heat transfer are not needed, the supply of hydrocarbon fuel can be turned off. This would result in a reduction of carbon dioxide ($CO_2$) in the products of combustion.

With the introduction of the 3-10 volume % of hydrocarbon fuel that is heated prior to mixing with the combustion air, the luminosity and radiant heat transfer of the flame is greatly improved and the benefits of using hydrogen as a fuel are only minimally affected as can be seen in FIGS. 9-12.

The inventive burner may also be provided with a flat flame nozzle can further increase radiative transfer or may be used in conjunction with high emissivity coatings that increase re-radiation within the furnace.

Whereas particular aspects of this invention have been described above for purposes of illustration, it will be evident to those skilled in the art that numerous variations of the details of the present invention may be made without departing from the invention.

The invention claimed is:

1. A combustion burner using hydrogen as the primary fuel, the burner comprising:

a burner housing enclosing a plenum;

a hydrogen fuel conduit extending longitudinally within the housing and defining a hydrogen fuel exit opening;

a combustion air conduit extending longitudinally within the housing and defining a combustion air exit opening;

a hydrocarbon fuel conduit defining a hydrocarbon fuel exit opening; and a mixing/combustion zone in which the hydrogen fuel, the combustion air, and the hydrocarbon fuel mix and combustion takes place, wherein the hydrocarbon fuel exit opening is positioned such that the hydrocarbon fuel injected from the hydrocarbon fuel exit opening is heated prior to mixing with the combustion air injected from the combustion air opening; and a baffle including a baffle face, wherein the baffle is positioned between the plenum and a burner port block that defines the mixing/combustion zone, wherein combustion air entering the mixing/combustion zone from the combustion air exit opening and hydrogen fuel entering the mixing/combustion zone from the hydrogen fuel exit opening enter a first area adjacent to the baffle face while hydrocarbon fuel enters the mixing/combustion zone in a second area that is farther from the baffle face than the first area.

2. The combustion burner of claim 1, wherein the combustion air conduit is offset from the hydrogen fuel conduit.

3. The combustion burner of claim 1, wherein the hydrocarbon fuel conduit extends in a longitudinal direction through the hydrogen fuel conduit and is positioned coaxial with the hydrogen fuel conduit and the burner centerline.

4. The combustion burner of claim 1, wherein the hydrocarbon fuel conduit extends beyond the baffle face into the mixing/combustion zone.

5. The combustion burner of claim 1, wherein the baffle includes a chamber into which hydrogen fuel injected through the hydrogen fuel exit opening and hydrocarbon fuel injected through the hydrocarbon fuel exit opening are injected before entering the mixing/combustion zone and combustion air injected from the combustion air exit opening enters an area adjacent to the baffle face.

6. The combustion burner of claim 1, wherein the hydrocarbon fuel conduit extends in a longitudinal direction along an axis that is offset from the burner centerline and/or offset from an axis along which the hydrogen fuel conduit extends.

7. The combustion burner of claim 1, wherein the hydrocarbon fuel conduit surrounds the hydrogen fuel conduit and the hydrocarbon fuel exit opening is an annulus or multiple openings surrounding the hydrogen fuel exit opening.

8. A method of firing a combustion burner using hydrogen as the primary fuel, the method comprising:

injecting hydrogen fuel into a mixing/combustion zone of the combustion burner;

injecting combustion air into the mixing/combustion zone of the combustion burner; and injecting a hydrocarbon fuel into the mixing/combustion zone of the combustion burner such that the hydrocarbon fuel is heated prior to mixing with the combustion air, wherein the hydrogen fuel is injected at a higher velocity than a velocity at which the hydrocarbon fuel is injected.

9. The method of claim 8, wherein the hydrocarbon fuel is introduced into a hot zone of the mixing/combustion zone such that at least a portion of the hydrocarbon fuel undergoes thermal decomposition and reformation into carbonaceous soot particles prior to mixing with the combustion air entering the mixing/combustion zone and combusting.

10. The method of claim 8, wherein injection angles and velocities for the introduction of the hydrocarbon fuel and the combustion air are set to minimize initial mixing of the hydrocarbon fuel with the combustion air.

11. The method of claim 8, wherein the combustion air is enriched with additional oxygen.

12. The method of claim 8, wherein the combustion air is preheated prior to being injected into the mixing/combustion zone.

13. A method of firing a combustion burner using hydrogen as the primary fuel, the method comprising:

injecting hydrogen fuel into a mixing/combustion zone of the combustion burner;

injecting combustion air into the mixing/combustion zone of the combustion burner; and injecting a hydrocarbon fuel into the mixing/combustion zone of the combustion burner such that the hydrocarbon fuel is heated prior to mixing with the combustion air, wherein the hydrocarbon fuel is provided as 3-10 volume % of the total injected hydrogen fuel plus hydrocarbon fuel.

14. The method of claim 8, wherein the hydrocarbon fuel is preheated prior to introduction into the mixing/combustion zone, such that partial decomposition and reformation of the hydrocarbon fuel occurs prior to the introduction of the hydrocarbon fuel into the mixing/combustion zone.

15. The method of claim 13, wherein the combustion air is enriched with additional oxygen.

16. The method of claim 13, wherein the combustion air is preheated prior to being injected into the mixing/combustion zone.

17. The method of claim 13, wherein the hydrocarbon fuel is preheated prior to introduction into the mixing/combustion zone, such that partial decomposition and reformation of the hydrocarbon fuel occurs prior to the introduction of the hydrocarbon fuel into the mixing/combustion zone.

* * * * *